US006755550B1

(12) United States Patent
Lackey

(10) Patent No.: US 6,755,550 B1
(45) Date of Patent: Jun. 29, 2004

(54) RECESSED ILLUMINATED TILE LIGHT

(76) Inventor: Amy Lackey, 2189 W. Cedar La., Atlanta, GA (US) 30311

( * ) Notice: Subject to any disclaimer, the term of this patent is extended or adjusted under 35 U.S.C. 154(b) by 0 days.

(21) Appl. No.: 10/358,372

(22) Filed: Feb. 6, 2003

(51) Int. Cl.[7] ..... F21S 8/00

(52) U.S. Cl. ..... 362/147; 362/294; 362/351; 362/364; 362/373; 362/800; 362/806

(58) Field of Search ..... 362/147, 294, 362/351, 362, 364, 373, 800, 806, 153, 148

(56) References Cited

U.S. PATENT DOCUMENTS 1,888,733 A * 11/1932 McCabe ..... 362/364
2,899,542 A * 8/1959 De Mauro ..... 362/364
3,064,851 A * 11/1962 Guigli ..... 16/232
3,076,890 A * 2/1963 Guth, Jr. ..... 362/319
3,753,217 A 8/1973 Willfurth
4,377,059 A 3/1983 Kuhr
5,373,431 A * 12/1994 Hayman et al. ..... 362/364
5,390,093 A 2/1995 Himeno et al.
6,082,878 A 7/2000 Doubek et al.

* cited by examiner

*Primary Examiner*—Sandra O'Shea
*Assistant Examiner*—Sharon Payne
(74) *Attorney, Agent, or Firm*—William B. Noll

(57) ABSTRACT

A recessed lighting system for a vertically oriented tiled wall. The housing comprises a generally rectangular receptacle having plural side wall and a base, where the latter mounts a lighting source. Overriding the housing is a tile frame support, hingedly secured to a side wall of the housing, where the frame support mounts plural, spaced apart tiles, comparable to those found in adjacent wall areas, where the spaces between the tiles are in light communication with the lighting source to thereby allow light rays to pass to the surrounding atmosphere.

8 Claims, 6 Drawing Sheets

RECESSED ILLUMINATED TILE LIGHT

FIELD OF THE INVENTION

This invention is directed to the field of recessed lighting systems, more particularly to a recessed illuminated light assembly for walls, where the assembly includes an overlay of plural spaced apart tiles with the light projecting through the tile spaces.

BACKGROUND OF THE INVENTION

The present invention relates to a unique recessed lighting system for use in combination with an array of wall tiles, where the system relies upon a plurality of spaced apart tiles overlying the light source of the system with the light showing through the spaced apart tiles.

Recessed lighting systems for ceilings are well known and can take a variety shapes and styles. One well known system is a suspended ceiling that includes a plurality of metal frame, T-shaped supports arranged to define a plurality of rectangular openings, typically 2'×4' or 2'×2' openings, where the openings are filled with acoustical type panels. At selected opening locations, the panels are replaced by a lighting fixture in the space above the ceiling and a clear or translucent plexiglas panel to allow lighting to be transmitted to the area below the ceiling.

The prior art, as reflected in the following U.S. Patents, teach a number of lighting concepts that may be adapted for residential or commercial use, namely:

U.S. Pat. No. 3,753,217, to Willfurth, teaches a recessed light primarily for use in a staircase to be positioned within a recess in the baseboard or wall at one side of the staircase to illuminate a tread of the staircase. There may be one such light for each tread or they may be spaced in any desired manner to illuminate selected treads. The recessed light is formed as an open housing from a section of a sheet metal reentrant face with upper and lower Lips to engage the upper and lower edges of a recess into which the housing snugly fits. The lips may be secured to said recess edges by nailing or by a suitable adhesive and may also be formed with integral projecting teeth or prongs to be driven into the recess edge portions for securing the housing in place. Provided centrally of the concave face of the housing is an opening for an electric light bulb. Each end of the housing is provided with an end wall so as to completely close of the recess. The housing may also take the form of a square-shaped frame at the outer edge of the concave face, the sides of the frame forming lips engageable with the outer side edge portions of the recess into which the housing is fitted.

U.S. Pat. No. 4,377,059, to Kuhr, discloses a suspended ceiling system comprising a plurality of inverted-T runners. Kerfed edge ceiling tile are used and supported by runners and concealing the bottom of the runners. At least one ceiling tile has a central portion removable therefrom by being separable along a substantially vertical fine cut made by high pressure fluid jet cutting.

U.S. Pat. No. 5,390,093, to Himeno et al. is directed to an illuminating display device for use with a mosaic panel, in which necessary display devices, measuring instruments, and the like are mounted to a cross-wise shaped metallic grid, to form a panel surface. Included therewith are light-emitting diodes arranged at a high density to afford a high-luminance display surface. The illuminating display device prevents the display surface and the interior of the display device from increasing in temperature due to heat generated by a large number of light-emitting diodes. The whole illuminating display device is composed of a base frame mountable to and removable from the grid, and a circuit board and a reflector to be mounted on the base frame. The base frame is composed of a leg, which is in face-to-face contact with a partitioning wall of the grid and which is engaged with the grid by its engaging claw, and a base seat on which a circuit board and others are mounted, wherein the base seat and the leg are made of metal and integrally provided. By this arrangement, heat generated by illumination of the light-emitting diodes is conducted via the base frame to the metallic grid, thus effectively radiated as a whole.

U.S. Pat. No. 6,082,878, to Doubek et al. relates to an adjustable recessed light fixture that comprises a lamp positionable in orientations wherein the light beam is inclined obliquely relative to a vertical axis, and wherein the inclined light beam can be rotated about the vertical axis. A movable stop is provided which enables the lamp to be rotated in a complete 360 degree range of rotation. A housing which covers the light fixture includes a removable top wall which provides an effective thermal insulation for the housing. A trim ring is installable such that tension springs of the trim ring are effectively held within a rotatable spin disc of the light fixture. The lamp can be rotated about a horizontal axis in a manner wherein only a minimal portion of a light beam is cut off by a reflector. A bar hangar for hanging a light fixture; frame to aceiling joist includes relatively sidable rails, wherein ends of the rails can be broken off to shorten the bar hanger without having to disconnect the rails from one another.

While the foregoing prior art offer several lighting systems to modify the lighting scheme of a room, none present a lighting system as unique as that offered by this invention. The owner, by the use of the system hereof for the wall of a room, closet, or hallway, has the ability to set the ambiance of the area, especially by the use of a dimmer switch as the control mechanism. The manner by which the owner of the system hereof can readily control the ambience in the area to be lighted will become more apparent in the description which follows, particularly when read in conjunction with the accompanying drawings.

SUMMARY OF THE INVENTION

This invention relates to a recessed lighting system, more particularly to the combination of a generally planar, vertically oriented wall, such as in a room, closet or hallway, suitable for fixedly mounting a plurality of rectangular shaped tiles, and a recessed lighting system. The system comprises a light housing for recessing within the wall, where the housing consists of a base and plural side walls. The side walls are defined by a free edge aligned planarly with the vertically oriented wall. Included therewithin is a frame support recessed from the free edge for mounting a plurality of comparable tiles. A plurality of comparable tiles are mounted to a removably mounted frame support, where the comparable tiles are spaced apart from an adjacent comparable tile, by a space equal to the normal spacing in which grouting is placed. Finally, a light source, such as a low wattage LED bulb, fixed within the light housing, where the source, when activated, preferably by a dimmer switch, will show through the spaces between the comparable tiles. Preferably, the light housing comprises a generally rectangular base having a side dimension equal to about the length of a pair of comparable tiles laid in close proximity to one another. The housing may mount a single, centrally disposed light, or the housing base may be defined by a generally rectangular peripheral recess in which the light source is positioned.

Accordingly, a feature of this invention is to provide an indirect orn accent lighting source for a room, closet or hallway, by the use of a wall recessed lighting system in combination with a tiled wall, where the controlled light emanates between pairs of spaced apart tiles.

Another feature of the invention is the provision of a wall recessed lighting system that allows the owner to set the desired ambiance in a room, closet or hallway utilizing the lighting system hereof.

A further preferred feature of the lighting system of the invention lies in the use of a low wattage LED bulb as the lighting source to minimize the generation of heat behind the wall.

These and other features of the lighting system hereof will become more apparent, particularly by those skilled in the art, from the following specification and drawings.

DETAILED DESCRIPTION OF PREFERRED EMBODIMENT

Figure 1:
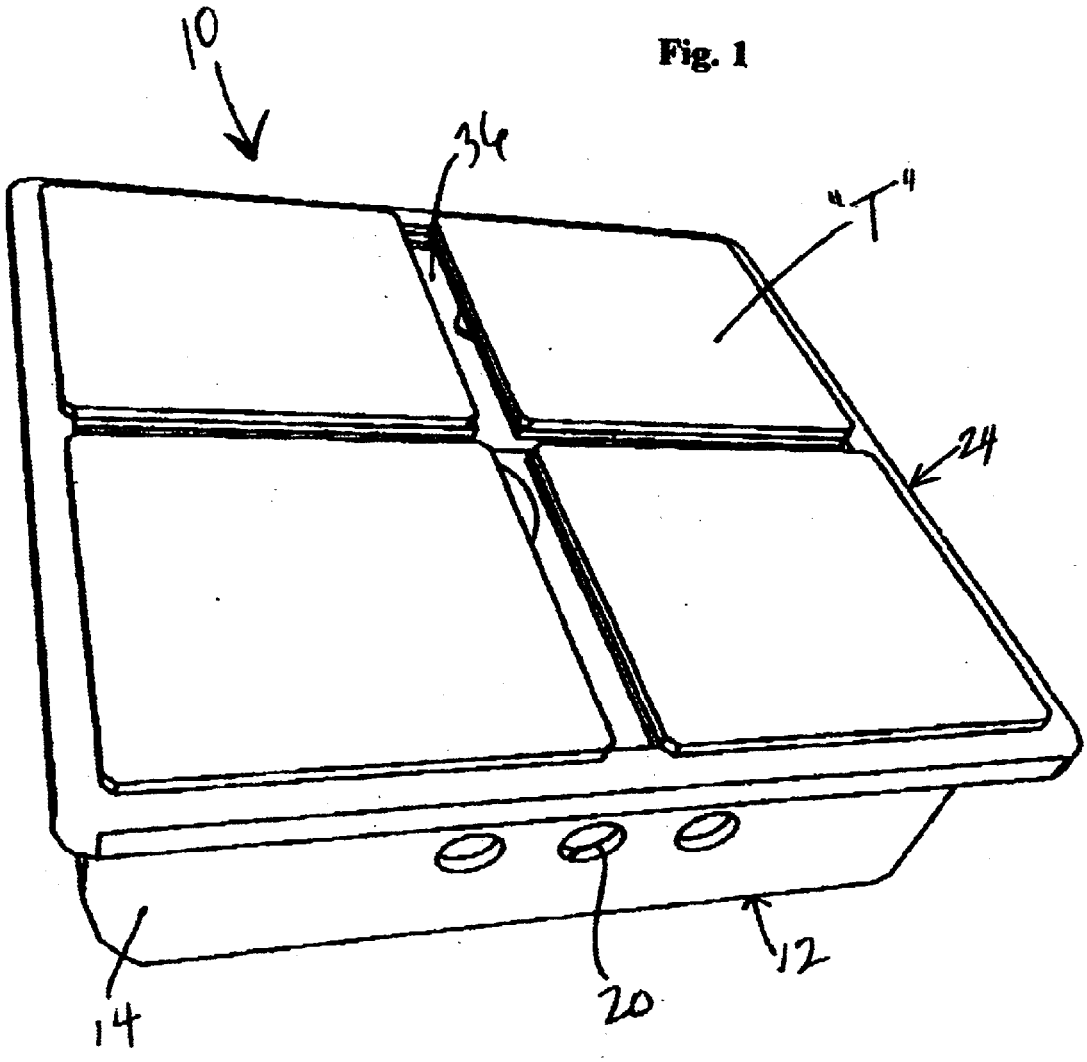
FIG. 1 is a perspective view of a first embodiment for a recessed illuminated tile light system, such as for mounting between the vertical studs of a wall, according to the present invention.
Figure 2:
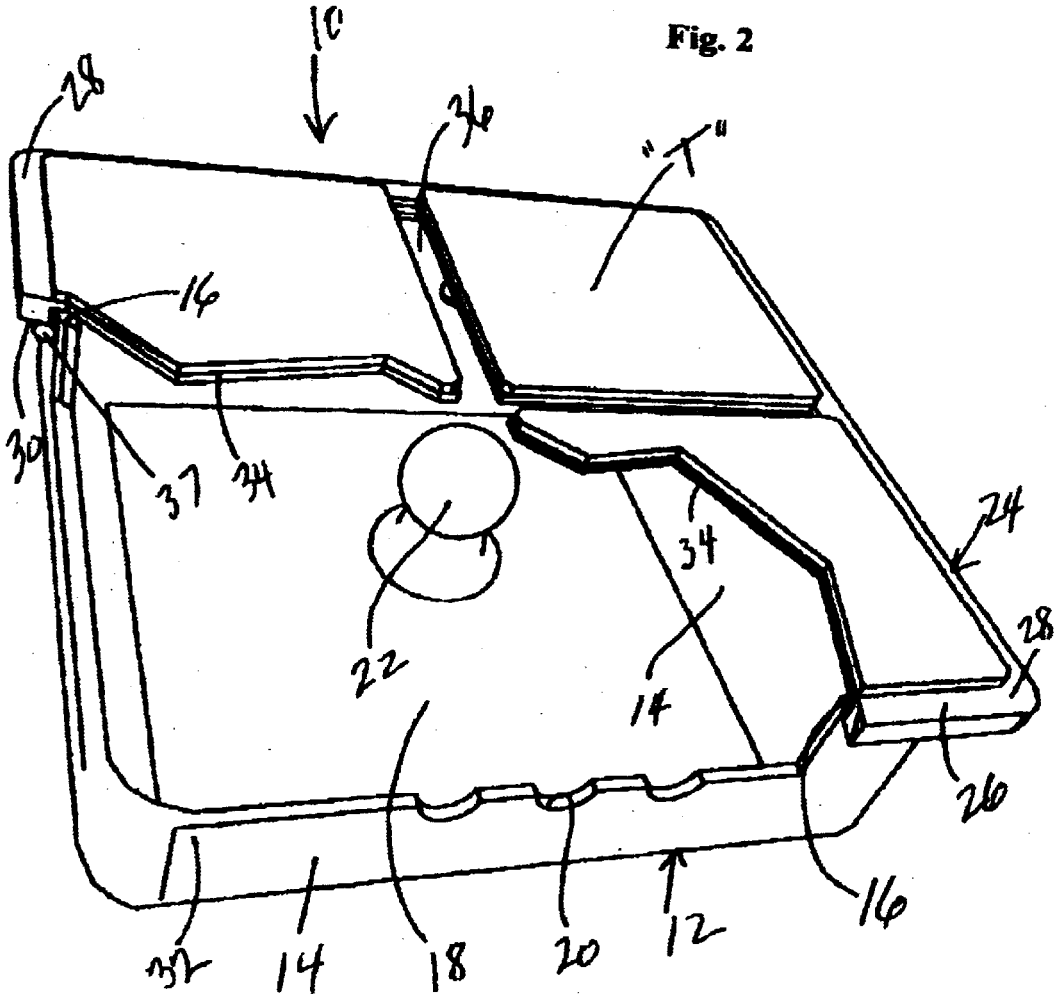
FIG. 2 is a perspective view similar to FIG. 1, with parts removed to reveal internal details of the system housing.

The present invention relates to a recessed wall lighting system, such as for accent lighting for a room, closet and hallway that provides a comfortable and relaxing atmosphere for the area and its occupants. The lighting system is not intended as the major light source for the designated area, but rather to provide accent lighting through the use of at least one recessed lighting housing, overlaid with plural spaced apart tiles, with the controlled lighting emitting through the open spaces between adjacent tiles. The lighting system, particularly as used in combination with a tiled wall, where comparable tiles overlay the lighting housing, will now be described with regard to the several Figures, where like reference numerals represent like components or features throughout the various views.

Turning first to the embodiment of FIGS. 1–4, for the recessed illuminated tile light system 10 of this invention, the system hereof comprises a generally rectangular housing 12 with a preferred size capable of readily seating between a pair of vertical studs, typically on 16" center lines. The housing 12 features plural, upstanding side walls 14 terminating in a planar upper edge 16, and a base 18. In this first embodiment, one or more side walls may include plural heat release openings 20 to dissipate heat from a light source 22 centrally mounted on the base 18.

Figure 3:
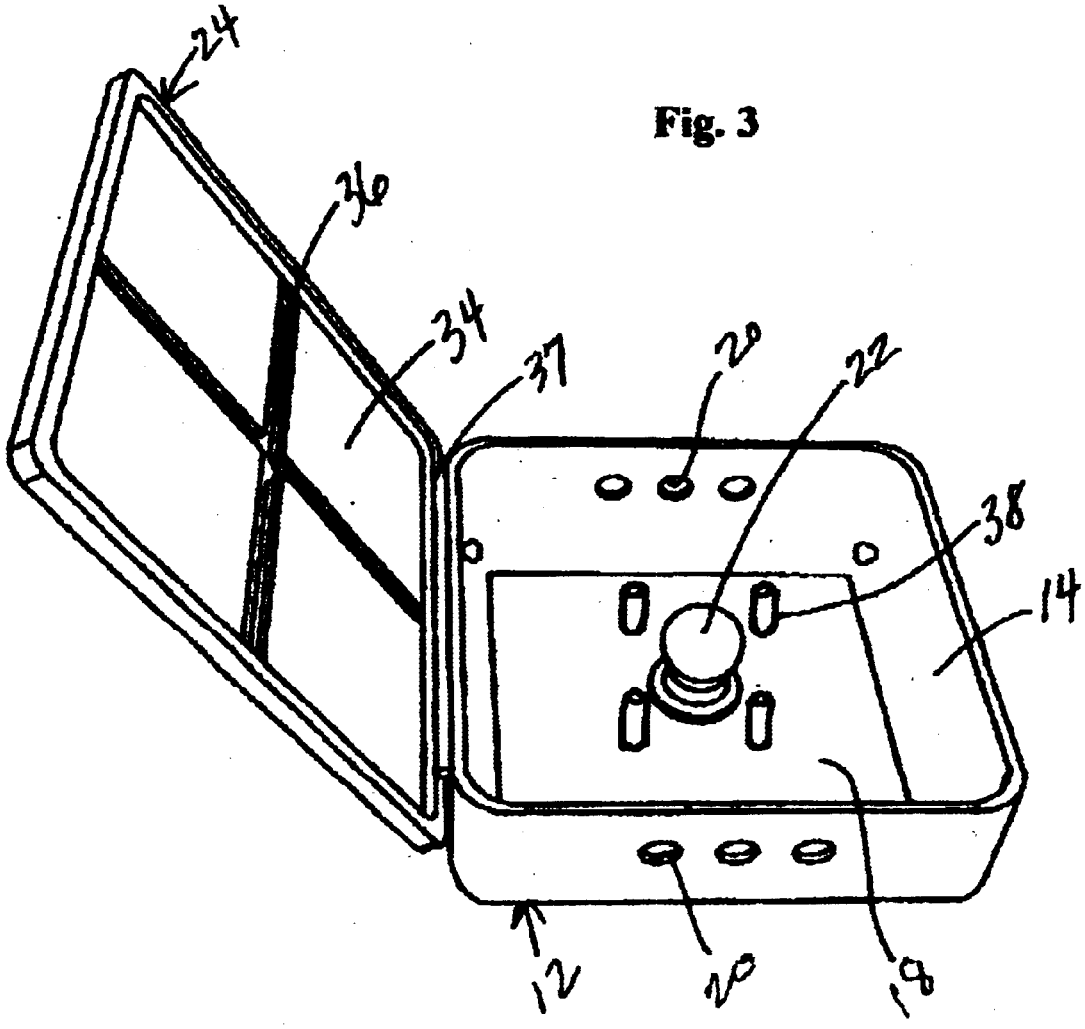
FIG. 3 is a perspective view of the embodiment of FIGS. 1 and 2, showing a hinged cover frame with tiles, for allowing access to the interior for maintenance purposes.

Overriding for seating against said upper edge 16 is a tile support frame 24, where said frame is discontinuous for reasons to be explained later. The tile support frame 24 comprises a continuous peripheral edge 26 having a planar surface 28 with a downwardly extending flange portion 30 to lie contiguous with the outer face 32 of the respective said side walls 14. Extending inwardly, and planarly aligned with the surface 28, are plural quadrant sections 34, where said sections are spaced apart 36 from an adjacent section by a distance comparable to that typically found for grouting when laying tiles on a surface. Secured to the respective sections 34 are a series of tiles "T", where said tiles are spaced apart a distance comparable to the distance between the respective, underlying sections 34. By this arrangement, as the light source 22, such as a single light bulb, is illuminated, the light rays win pass outward through the spaced apart openings to provide a unique secondary light to the room, such as in the form of a 'cross'. Further, since changing the light bulb may be required periodically, the tile support frame 24 may be hingedly connected by hinge element 37, such as between the side wall 14 and flange portion 30, where FIG. 3 shows the support frame pivoted relative to the housing 12. Further, as shown in FIG. 3, the base 18 may include plural, upstanding posts 38 to provide stabilizing supports for the respective sections 34.

Figure 5:
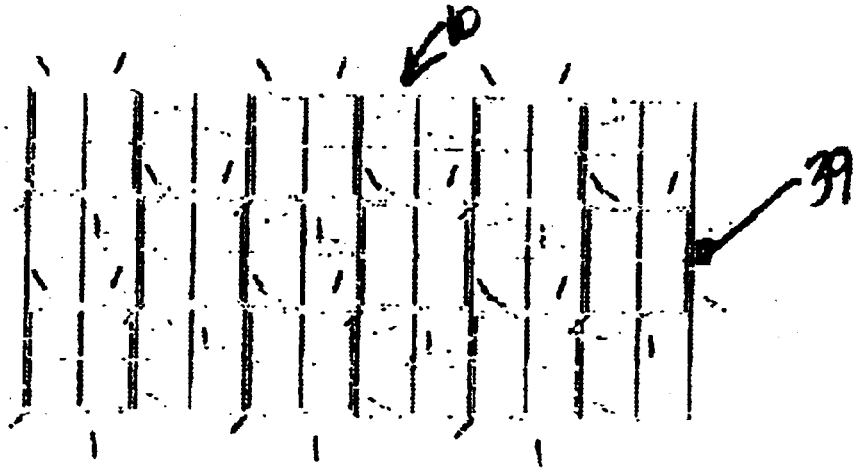
FIG. 5 is a plan view of an array of recessed illuminated tile light systems as may be found in relation to a wall, for example.
Figure 4:
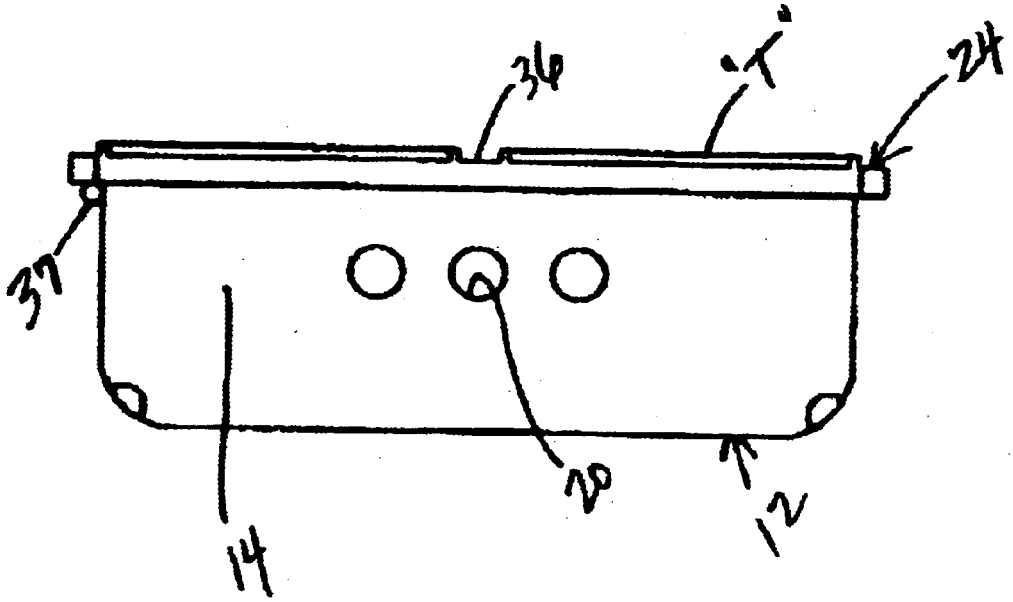
FIG. 4 is a side view of the closed system housing and cover frame.
Figure 6:
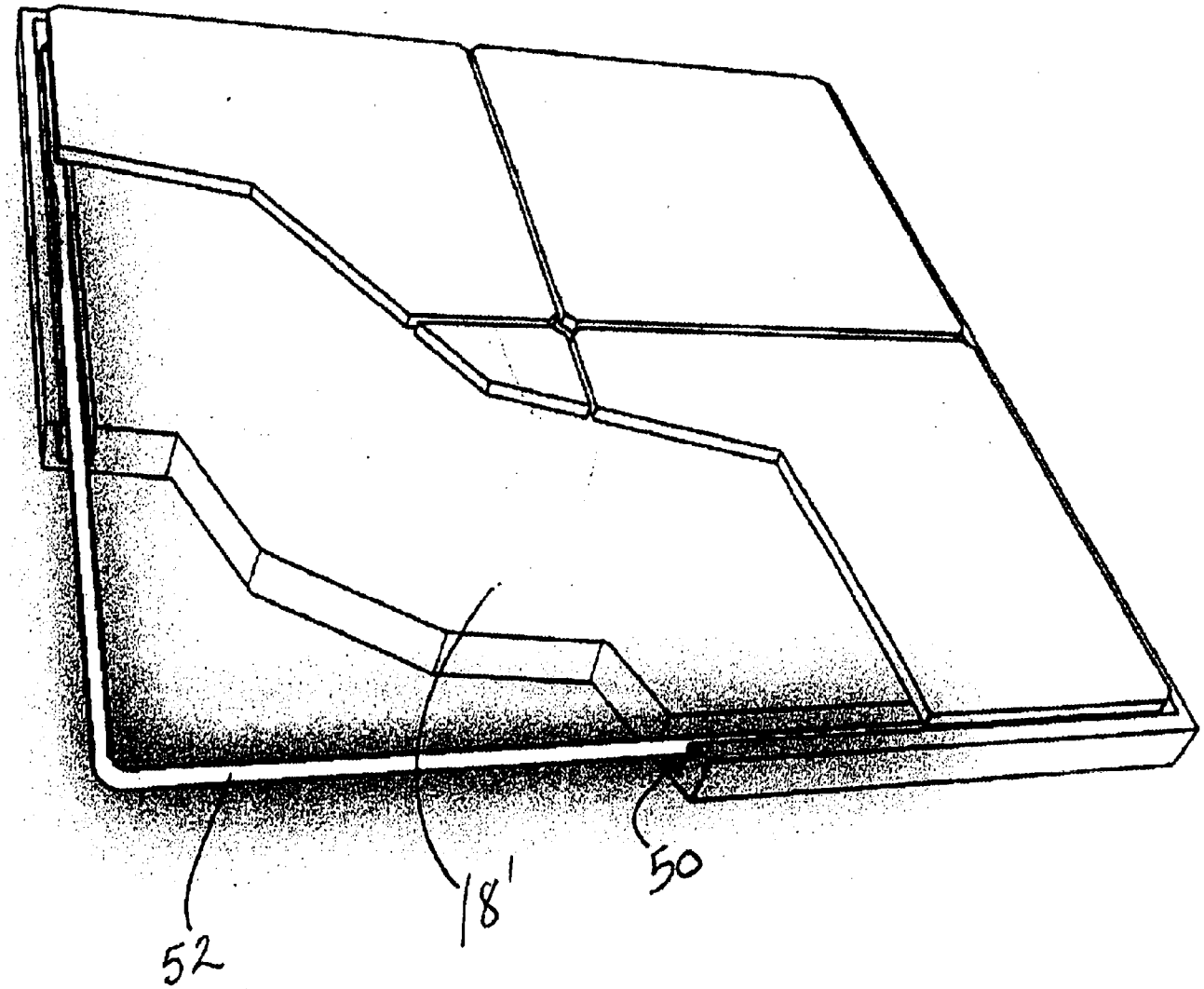
FIG. 6 is a partial perspective view of a second embodiment for the recessed illuminated tile light system of this invention.

FIG. 5 illustrates a plurality or array of adjacent recessed wall housings mounted in a wall to show the manner by which an entire wall may be lighted by the system hereof. The number of recessed housings and accompanying lighting sources will be dependent upon the occupant's desire to create the level of accent in the room, closet or hallway. To further add to and control the secondary light from the respective recessed housings, a wall switch 39, preferably a dimmer switch or rheostat, may be provided, where current to the lighting source is provided by the structure's electrical source, i.e. house current, as known in the art.

Figure 7:
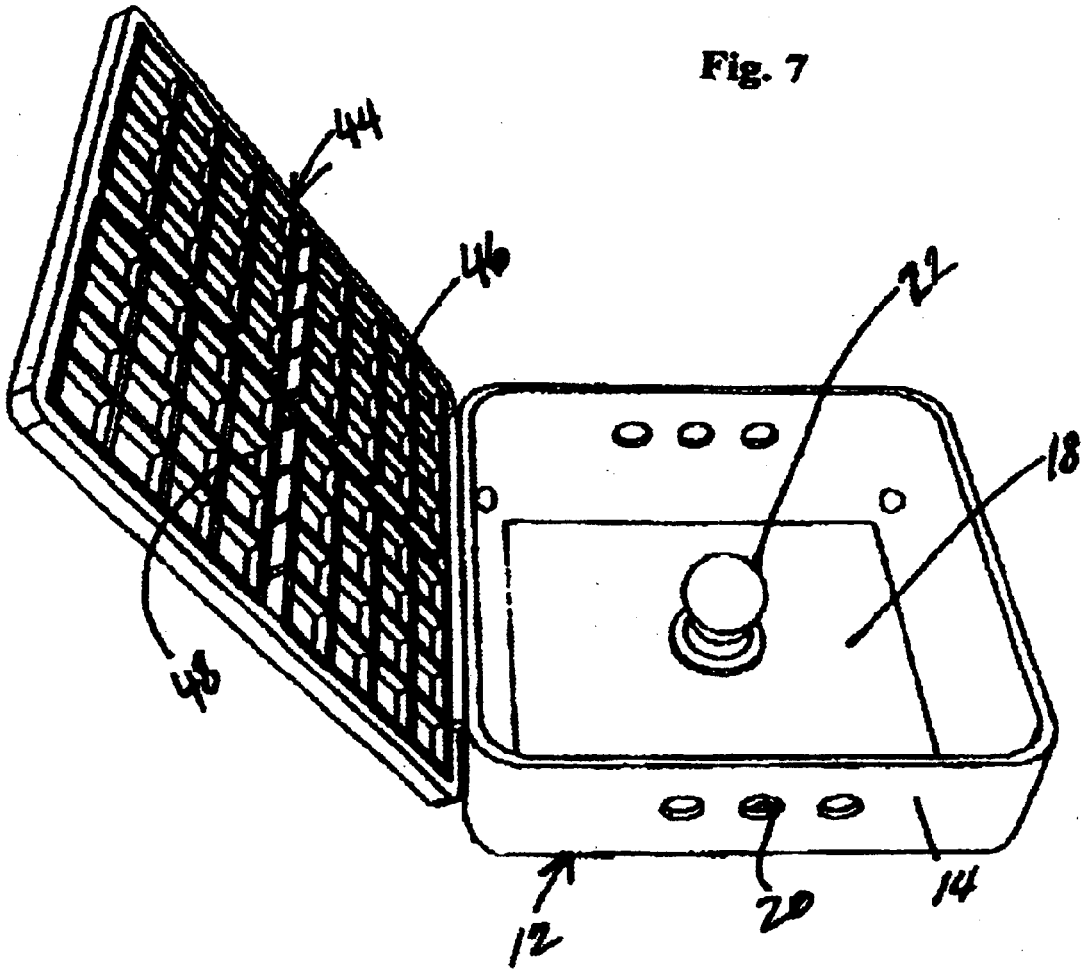
FIG. 7 is a perspective view, similar to FIG. 3, showing an alternative tile frame support in the form of an open grid system.

FIG. 7, a perspective view similar to FIG. 3, shows an alternative design for a tile support frame 44. The alternate support frame 44 comprises a grid system formed by a series of parallel and perpendicular frame sections 46, such as may be formed of plastic or aluminum. The upper or outer edges 48 are planarly aligned to provide a planar surface for mounting the respective tiles as discussed above.

While one system for providing light to the recessed housing has been shown in FIGS. 1–4, FIG. 6 illustrates a second type of lighting that may be used. Specifically, the base 18' may be modified by the inclusion of a peripheral groove 50 within which is mounted a continuous LED light bulb 52, a low wattage bulb, as known in the art This lighting source has the advantage of minimizing the generation and hence dissipation of heat from behind the wall. Altemately, the LED light bulb may comprise a series of string lights along the groove 50, where the lights may be removably positioned and temporarily secured therewithin. Or, the string lights, running horizontally and vertically, may be inserted within the spaces normally containing grout such that the lights resemble the grout.

It is recognized that changes, variations and modifications may be made to the recessed lighting system of this invention without departing from the spirit and scope thereof. Accordingly, no limitation is intended to be imposed thereon except as set forth in the accompanying claims.

I claim:

1. In combination with a generally planar, vertically oriented wall suitable for fixedly mounting a plurality of rectangular shaped tiles, a recessed lighting system comprising:

a.) a light housing for recessing within said wall, said light housing consisting of a base and plural side walls, where said side walls are defined by a free edge aligned planarly with said vertically oriented wall, and a frame support hingedly mounted to a said free edge for receiving a plurality of said tiles;

b.) a plurality of said tiles secured to said frame support, where said tiles are spaced apart from an adjacent said tile; and, c.) a light source fixed within said light housing, which light source when activated will show through the spaces between said tiles.

2. The combination according to claim 1, wherein said light housing comprises a generally rectangular base having a side dimension equal to about the length of a pair of said comparable tiles laid in close proximity to one another.

3. The combination according to claim 2, wherein said base is defined by a generally rectangular recess, said light source being positioned within said rectangular recess.

4. The combination according to claim 3, wherein said rectangular recess is a three-sided, rectangular channel.

5. The combination according to claim 4, wherein said light source is an LED light bulb.

6. The combination according to claim 2, wherein said generally rectangular base is planar and mounts a single, centrally disposed said light source.

7. The combination according to claim 6, wherein at least one said side wall includes plural through openings for dissipating heat from said single, centrally disposed light source.

8. The combination according to claim 1, wherein said frame support comprises a grid member consisting of plural members arranged in parallel and perpendicular to one another, where said members feature outer edges planarly aligned to support said comparable tiles.

* * * * *